United States Patent [19]

Bauer et al.

[11] Patent Number: 4,477,420

[45] Date of Patent: Oct. 16, 1984

[54] PROCESS FOR SEPARATING, ESPECIALLY IN MULTIPLE STAGES, ACID COMPONENTS SUCH AS $CO_2$, HCN AND SPECIFICALLY $H_2S$, FROM GASES, ESPECIALLY FROM COKE OVEN GASES, BY MEANS OF AMMONIA RECIRCULATION SCRUBBING

[75] Inventors: Hartmut K. Bauer, Essen; Ernst A. W. Otte, Müheim, both of Fed. Rep. of Germany

[73] Assignee: Didier Engineering GmbH, Fed. Rep. of Germany

[21] Appl. No.: 400,375

[22] Filed: Jul. 21, 1982

Related U.S. Application Data

[63] Continuation-in-part of Ser. No. 285,833, Jul. 22, 1981, abandoned.

[30] Foreign Application Priority Data

Aug. 12, 1980 [DE] Fed. Rep. of Germany ..... 3030435

[51] Int. Cl.³ ..... B01D 53/34

[52] U.S. Cl. ..... 423/234; 423/236; 423/238

[58] Field of Search ..... 423/220, 234, 236, 237, 423/238, 356

[56] References Cited

U.S. PATENT DOCUMENTS

| | | | |
|---|---|---|---|
| 3,556,721 | 1/1971 | Radusch | 423/220 X |
| 4,009,243 | 2/1977 | Weber et al. | 423/234 |

FOREIGN PATENT DOCUMENTS

| | | | |
|---|---|---|---|
| 1085641 | 7/1960 | Fed. Rep. of Germany . | |
| 1091273 | 10/1960 | Fed. Rep. of Germany . | |
| 1107882 | 7/1961 | Fed. Rep. of Germany . | |
| 2056727 | 10/1977 | Fed. Rep. of Germany . | |
| 455648 | 10/1936 | United Kingdom | 423/237 |

*Primary Examiner*—Earl C. Thomas

*Attorney, Agent, or Firm*—Wood, Herron & Evans

[57] ABSTRACT

A process of separating in multiple stages acid components in coke oven gas such as $CO_2$, HCN and particularly $H_2S$ by ammonia scrubbing wherein the ammonia used in scrubbing is deacidified to remove the acid components and is recirculated to the scrubbing process at least in part as substantially pure liquid ammonia.

11 Claims, 1 Drawing Figure

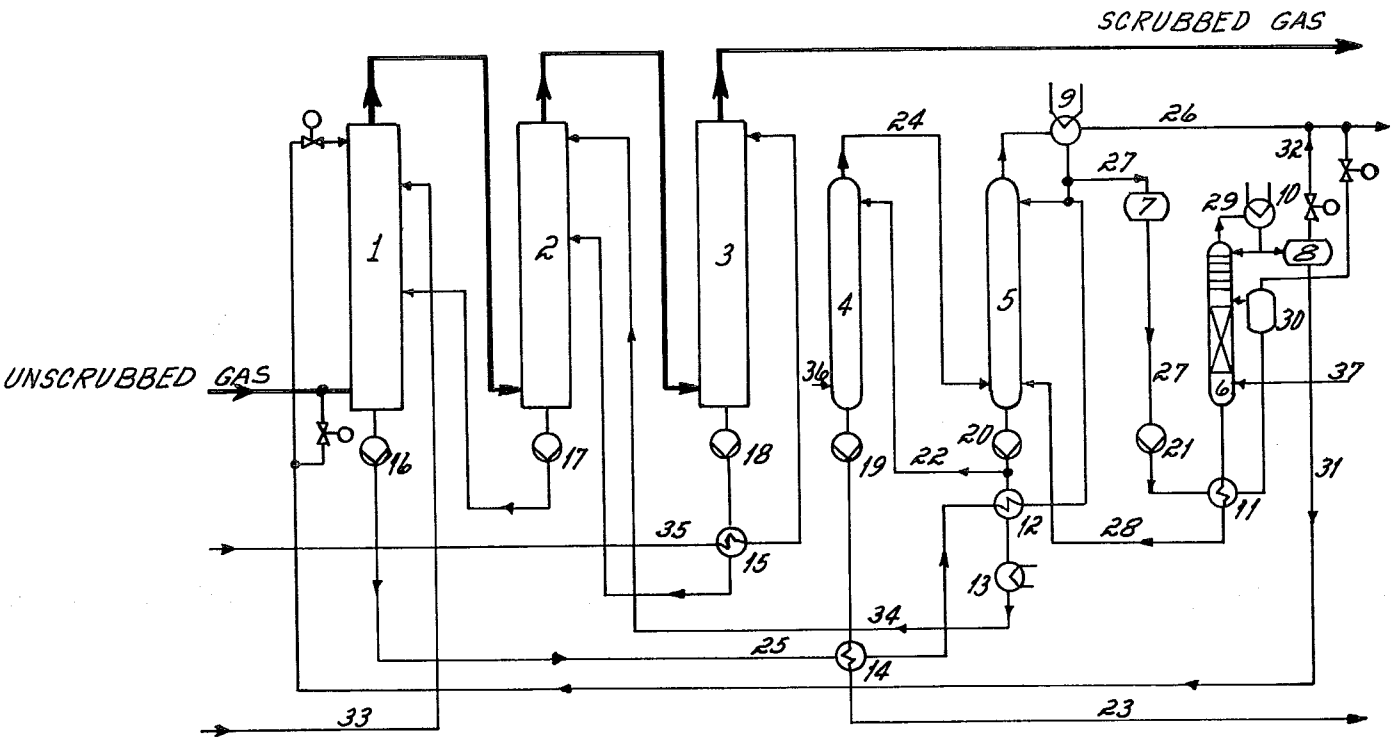
SCRUBBED GAS
UNSCRUBBED GAS

PROCESS FOR SEPARATING, ESPECIALLY IN MULTIPLE STAGES, ACID COMPONENTS SUCH AS $CO_2$, HCN AND SPECIFICALLY $H_2S$, FROM GASES, ESPECIALLY FROM COKE OVEN GASES, BY MEANS OF AMMONIA RECIRCULATION SCRUBBING

CROSS-REFERENCE TO RELATED APPLICATIONS

This application is a continuation-in-part of U.S. Ser. No. 285,833, filed July 22, 1981, now abandoned.

BACKGROUND OF THE INVENTION

This invention relates to a process for separating, specifically in multiple stages, acid components such as $CO_2$, HCN and specifically $H_2S$ from gases, specifically coke oven gases, by means of ammonia recirculation scrubbing wherein the ammonia which during scrubbing has been bound to the acid components is released by a deacidification treatment and recirculated to the scrubbing process at least in part as substantially pure liquid ammonia.

It is known in the art to separate the acid components of a gas with a suitable eluant and then separate the adsorbed acid components by suitable means from the eluant. Ammonia eluting for stripping $H_2S$ from gases containing up to about 1.0 to 1.5 g $H_2S/m^3$ under normal conditions is state of the art. Recently, a number of improvements have been suggested. For example, German patent document 20 56 727 disclosed a process in which both gaseous and dissolved ammonia are used for hydrogen sulfide scrubbing. In addition, numerous attempts have already been made at increasing the ammonia content of the wash water in the deacidification stage, e.g., as disclosed in German patent publication 1,107,882; or to subdivide the separation process into several stages, using first an ammonia water with a higher ammonia concentration and, in the second stage, an ammonia water of customary concentration as shown in German patent publication 1,091,273. Also known from German patent publication 1,085,641 is the separate use of ammonia gas containing hydrogen sulfide, for one, and of pure ammonia gas obtained from ammonia salts or other sources, in a hydrogen sulfide scrubber. While these and many other patents disclose separate treatment of the gases to be stripped of acid components, and specifically of $H_2S$, and specifically in coke oven gas by means of ammonia scrubbing, either ammonia eluants or gaseous ammonia are employed.

Due to present environmental regulations, it is necessary to reduce especially the $H_2S$ content in the purified gas. In order to meet these regulations with the aid of ammonia separation, ammonia must be recirculated to the process at least in the scrubbing of coke oven gas, since the natural ratio of $NH_3$ to $H_2S$ in the coke oven gas does not permit an extensive separation of the $H_2S$. Normally, the ammonia is recirculated into the separation process by way of a so-called deacidifier. As its name implies, the deacidifier is used to remove the acid components from the ammonia eluant and retain the ammonia. For reasons of equilibrium, however, in this process part of the acid component remains in the eluant solution. This leads to two essential disadvantages of such a procedure. First, because of the residual content of acid components, only about 80% of the ammonia contained in the eluant solution is available for scrubbing. Second, and more aggravating, the partial pressure of the acid components, especially of the $H_2S$, above the deacidified eluant solution prevents the $H_2S$ separation down to the presently specified values.

SUMMARY OF THE INVENTION

The problem underlying the present invention is to provide an economical process for ammonia $H_2S$ separation which overcomes the above-recited disadvantages.

Surprisingly, it has now been found that the disadvantages of the prior art processes can be avoided by recirculating the ammonia, at least in part, not in the form of an aqueous solution and/or in the form of an ammonia-water vapor mixture, but rather by introducing the ammonia in at least one stage of the scrubbing process as liquid ammonia. The resulting advantages are that such a liquid ammonia, substantially pure, possesses only a very slight solubility for acid components such as $H_2S$, $CO_2$ and HCN, which is by a factor $10^2$ to $10^3$ lower than in aqueous ammonia solutions. Because of this fact, the acid components can be easily stripped and employed for further processing. In addition, the substantially pure, liquid ammonia recirculated to the scrubbing process contains smaller portions of such acid components so that, due to the lower partial pressure of such acid components, a better separation effect of the solution forming in the scrubber is obtained for such acid components. Moreover, since the liquid ammonia contains only traces of acid components, the entire quantity of ammonia introduced for separation of the acid components can be utilized. A further advantage of the present invention is that the evaporative cold created by the expansion of the liquid ammonia dissipates heat directly from the gas to be scrubbed, so that the heat of solution generated in the scrubbing process is partially equalized. As a result, a further advantage is realized in that additional cooling of the circulating elution liquid becomes superfluous. In the last stage of the gas scrubbing, fresh water is preferably used.

The process of the present invention solves the above-recited problems in that the $NH_3$ condensate obtained in the stripping stage is stripped in yet another stage to render a substantially purer liquid ammonia and water with a low $NH_3$ content, and in that the liquid ammonia obtained in this stage is recirculated to at least one stage of the scrubbing process. The statement that the liquid ammonia is recirculated into at least one stage means that the recirculation of ammonia may occur both into the gas or with the gas introduced in this stage for treatment and also at any point in the scrubber.

Preferred embodiments of the inventional process are characterized in that:

(a) the liquid ammonia is recirculated into the scrubbing process in a quantity such that the mole ratio of acid components, specifically that of $H_2S$ to ammonia, in the gas to be scrubbed will be 1:2.5 to 1:4.5;

(b) the liquid ammonia is recirculated, with a triple-stage scrubbing, into the first two scrubbing stages;

(c) 60 to 90% of all the recirculated $NH_3$ is introduced into the first stage of the scrubbing process;

(d) in a triple-stage gas scrubbing, the scrubbing is performed in the second stage partly with the water driven off, which is obtained when stripping the acid components and the ammonia from the eluting liquid, and/or partly with the low-ammonia water obtained in stripping the $NH_3$ condensate;

(e) the condensate quantity selected for liquid ammonia production is prior to its introduction into the high pressure $NH_3$ stripping stage rid, in a degassing stage, of part of the acid components which are present in gaseous state;

(f) the $NH_3$ condensate is stripped in a high-pressure steam-stripping stage into condensed substantially pure liquid ammonia and water containing small amounts of ammonia;

(g) in stripping the $NH_3$ condensate into substantially pure liquid ammonia and water with a low $NH_3$ content, part of the condensed liquid ammonia is reintroduced as reflux into the high-pressure steam-stripping stage;

(h) the high-pressure steam-stripping is operated at customary cooling water temperature and at a pressure ranging from 10 to 25 bars;

(i) part of the liquid ammonia is introduced into the gas to be scrubbed either before or simultaneous with its introduction into the first scrubbing stage.

BRIEF DESCRIPTION OF THE DRAWING

The accompanying drawing is a schematic illustrating a three-stage scrubbing process with ammonia stripping in three stages.

DETAILED DESCRIPTION OF THE INVENTION

The largest quantity of the acid components present in the gas, particularly $H_2S$, is separated in the scrubber 1. The scrubbers 2 and 3 further the $H_2S$ and $NH_3$ separation. The conditioning of the eluting liquid takes place in the stripping stages 4, 5 and 6. The functions of the stages 4 and 5 can alternatively be performed in a single apparatus, which includes a partitioned bottom which corresponds to the sump of the stripping stage 5. Stripping stages 4 and 5 are operated with low-pressure steam. All of the waters used for the gas scrubbing are introduced at the head of the stripping stage 5. Added at the sump of the stripping stage 4 is low-pressure stripping steam in a quantity sufficient to produce a water discharge according to specification. Withdrawn from the sump of the stripping stage 5 or from a suitable partitioned bottom in the case of a single apparatus is scrubbing water with a low $NH_3$ content in the required quantity via line 34. The content of free $NH_3$ in this stream lies preferably between 0.5 and 1.0 g/l. This will assure that the content of acid components remaining in the solution is low.

The steam discharged at the head of the stripping stage 5 is partly condensed. Depending on the amount of ammonia required for recirculation into the stripping process, an appropriate condensation temperature is selected. As a rule, it ranges from 55° to 70° C.

The stripping stage 4 serves to properly condition the water to be removed from the process. The excess water flows to the stripping stage 4 from the sump of the stripping stage 5 via the line 22. In counterflow to the introduced water, the low pressure steam 36 is added at the sump of the stripping stage 4, in quantities such that, as described above, a discharge water true to specification—with a content of for instance 50 mg free $NH_3$/1—is obtained. This discharge water flows through the line 23 into the sewage system.

At the head of the stripping stage 4, steam slightly laden with $NH_3$ and acid components is passed via the line 24 to the stripping stage 5. Here, the steam is used to strip the water vapor of volatile components contained in the scrubbing liquid which upon heat exchange in the heat exchangers 14 and 12 is introduced via the head of the stripping stage. The steam discharging at the head of stripping stage 5 is after partial condensation in the condenser 9 passed for further conditioning via the line 26. The condensate accruing in the condenser 9, which in accordance with the condensing temperature is variously enriched with $NH_3$ and acid components, is partly recirculated to the stripping stage 5 as reflux.

The amount intended for the production of liquid ammonia is routed to a high-pressure $NH_3$ stripping stage 6 via the container 7 and the line 27. Here, all of the water vapor-soluble components are driven off from the introduced condensate by means of high pressure steam 37 introduced at a pressure of preferably 10 to 25 bars and especially at about 15 bars. The stripping is nearly complete so that almost pure water drains from the sump of the stripper 6, which upon heat exchange in the heat exchanger 11 is routed via line 28 to the sump of the stripping stage 5. The condensate amounts routed via the line 27 to the high-pressure $NH_3$ stripping stage 6 are preferably degassed in a degasser 30 for removal of the acid components which are present in gaseous state, which gas amounts are routed into the line 26.

The steam in line 29 discharging at the head of the stripping stage 6 is condensed in a condenser 10, thereby obtaining liquid ammonia. Part of this ammonia is preferably reintroduced into the stripping stage 6 as reflux. The $NH_3$ needed for $H_2S$ elution is routed via the container 8 and line 31 to the scrubbing process. Due to the very low solubility of acid components in pure $NH_3$, the liquid $NH_3$ used for $H_2S$ elution contains only traces of acid components. The acid components contained in the condensate routed to the stripper stage 6 are after expansion routed via line 32 into the line 26 and can be further processed in customary fashion.

The liquid $NH_3$ is recirculated to the scrubber 1 and may be advantageously introduced at two points, one at the head of the scrubber 1, and another, into the gas to be scrubbed which is introduced at the bottom of the scrubber 1. As previously described, the heat of solution generated by the $NH_3$ absorption in the elution water is partly equalized by the evaporative cold which occurs in the expansion of the liquid $NH_3$.

In addition, it is possible as well to add part of the liquid $NH_3$ to the scrubber 2, preferably with the gas fed to it, in the center of the scrubber. Still more extensive stripping of acid components can be accomplished thereby.

Element 13 is a cooler placed after the heat exchanger 12, which serves to absorb the residual heat of the water coming from the line 28 of the high-pressure $NH_3$ stripping stage 6, and of the water flowing from the stripping stage 5 into the line 34. The residual heat is thereby removed from the system.

Fresh water is fed into the scrubber 3 via line 35 so that the ammonia content of the scrubbed gas leaving the scrubber 3 can be reduced to levels in the order of 0.2 g $NH_3/m^3$ in normal condition.

The elution of $NH_3$ and acid components takes place, additionally, through the gas condensate which is fed via the line 33 to the scrubber 1 and through the separated water from the stripping stage 5 which is fed to the scrubber 2 via the line 34. The gas condensate in line 33 is generated by cooling the coke oven gases that are produced in the coking process. In addition, the water from the scrubber 3 is after heat exchange in the heat exchanger 15 fed to the scrubber 2, via its head, together with fresh water.

The remaining pumps necessary for the operation of the system are marked 16 through 21 in the drawing. Signified by 25 is the line for the acid laden elution water.

The invention will be more fully explained with the aid of the following example.

Using a system which essentially was identical with the one illustrated in the drawing, 140,000 $m^3/h$ of unpurified coke oven gas containing the following amounts of gaseous contaminates was fed to the scrubber 1 inlet. The stated gas quantities relate always to normal condition. The gas passed subsequently through the scrubbers 2 and 3 and left the last scrubber as purified gas. The scrubbing temperature was 25° C.

The results are compiled in the following table:

TABLE

| Component | In the Unscrubbed Gas $g/m^3$ | In the Scrubbed Gas $g/m^3$ | Gas Condensate 33 g/l | Laden Scrubbing Water 25 g/l | Conditioned Scrubbing Water 34 g/l | Condensate 27 g/l | Sewer Gas 26 kg/h | Driven-Off Water 28 g/l |
|---|---|---|---|---|---|---|---|---|
| $NH_3$ | 6.0 | 0.02 | 3.8 | 17.38 | 1.0 | 147.6 | 1051 | 2.09 |
| $H_2S$ | 7.0 | 0.20 | 0.7 | 6.51 | 0.03 | 70.7 | 249.1 | 0.21 |
| HCN | 1.5 | 0.3 | 0.48 | 1.27 | 0.02 | 10.9 | 77.2 | 0.06 |
| $CO_2$ | 59. | 51 | 5.40 | 9.49 | 0.26 | 60.7 | 774.8 | 0.45 |

From the stripping stage 6, 1550 kg/h of liquid $NH_3$ were rerouted to the scrubber 1, with 550 kg/h $NH_3$ being fed in this case into the gas line before the scrubber 1 and 1000 kg/h $NH_3$ to the head of the scrubber 1.

56 $m^3/h$ of gas condensate from the line 33 with the composition specified in the table was used as the scrubbing liquid in the scrubber 1 and, additionally, 97 $m^3/h$ scrubbing water coming from the sump of scrubber 2.

The acid laden scrubbing water from the sump of scrubber 1 was fed via the line 25 in a quantity of 153 $m^3/h$, after heat exchange in the heat exchangers 14 and 12, to the head of the stripping stage 5 and stripped there with the steam coming from the stripping stage 4.

The water that was partially stripped and removed from the sump of the stripping stage 5 was conveyed into the two pipelines by means of the pump 20. A flow of 57 $m^3/h$ was recirculated as scrubbing water to the scrubber 2 through the line 34 after heat exchange against the incoming enriched scrubbing water in the heat exchanger 12 and further temperature drop in the cooler 13. The remaining flow of 117 $m^3/h$ was conveyed through the line 22 to the stripper 4 and stripped there with 22 t/h low pressure stripping steam to waste water quality. The waste water draining from the stripping state 4 through line 23 contained only traces of acid components. The content of free $NH_3$ was less than 50 mg/l.

The gas which upon discharge from the scrubber 2 still had an excessive $NH_3$ content was stripped in the scrubber 3 to a final $NH_3$ content of 0.02 $g/m^3$, with 40 $m^3/h$ fresh water supplied through the line 35. The water draining from the sump of scrubber 3, only slightly laden, was routed to the scrubber 2 as additional scrubbing water.

The steam leaving the stripping stage 5 was cooled down to 60° C. in the condenser 9 and thereby partially condensed. Part of the condensate was fed as reflux to the stripping stage 5, and 10.6 $m^3/h$ of the condensate was passed, after heat exchange in the heat exchanger 11 at a temperature of about 145° C. to the stripping stage 6 which was operated at a pressure of 15 bars. 2.5 t/h high pressure steam for stripping was introduced into the sump of the stripping stage 6, through the line 37. The water left the stripping stage 6 substantially free of $NH_3$ at about 200° C. and was after heat exchange in the heat exchanger 11 recirculated into the sump of the stripping stage 5 through the line 28.

The ammonia vapor was condensed in the condenser 10, introducing 1240 kg/h of liquid $NH_3$ as reflux into the stripping stage 6. 1550 kg/h of liquid $NH_3$ was reintroduced, as described above, in the scrubber 1.

We claim:

1. In a process for separating acid components from gases in multiple stages by ammonia recirculation scrubbing wherein the ammonia bound to the acid components during scrubbing is released by a deacidification step to produce an ammonia condensate, the improvement comprising the steps of:

stripping said ammonia condensate to produce substantially pure liquid ammonia, and recirculating said liquid ammonia to at least one stage of the scrubbing process.

2. The process of claim 1 wherein said acid components include $H_2S$ and wherein said gases are from a coke oven.

3. The process of claim 1 or 2, respectively wherein said liquid ammonia is recirculated into the scrubbing process in an amount such that the mole ratio of $H_2S$ to ammonia in the gas to be scrubbed is in the range of about 1:2.5 to 1:4.5.

4. The process of claim 1 wherein the scrubbing process includes three stages in series and wherein the liquid ammonia is recirculated to the first two stages.

5. The process of claim 4 wherein about 60 to 90% of the liquid ammonia is introduced into the first stage of the scrubbing process.

6. The process of claim 1 wherein the scrubbing process includes three stages in series, the stripping of said ammonia condensate produces in addition a second stream of water having a low ammonia condensate, and wherein water from the stripping step and said second stream of water are recirculated to the second scrubbing stage.

7. The process of claim 1 wherein the ammonia condensate prior to the stripping step is degassed to remove part of the acid components present in the gaseous state.

8. The process of claim 1 wherein the ammonia condensate is stripped in a high pressure steam stage to form a stream of substantially pure ammonia which is then condensed.

9. The process of claim 8 wherein a part of the condensed liquid ammonia is introduced as reflux into the high pressure steam stripping stage.

10. The process of claim 8 wherein the stripping stage operates at a pressure in the range of 10 to 25 bars.

11. The process of claim 1 wherein at least a part of the liquid ammonia is introduced into the gas to be scrubbed prior to or simultaneously with the introduction of said gas into the first scrubbing stage.

* * * * *

UNITED STATES PATENT AND TRADEMARK OFFICE

CERTIFICATE OF CORRECTION

PATENT NO. : 4,477,420

DATED : October 16, 1984

INVENTOR(S) : Hartmut Bauer et al

It is certified that error appears in the above-identified patent and that said Letters Patent is hereby corrected as shown below:

Column 3, line 14, between "steam-stripping" and "is" insert --stage--.

Column 3, line 15, "temperature" should be --temperatures--.

Column 4, line 34, "stripper" should be --stripping--.

Column 5, line 51, "state" should be --stage--.

Signed and Sealed this

*Second* Day of *April 1985*

[SEAL]

*Attest:*

DONALD J. QUIGG

*Attesting Officer*

*Acting Commissioner of Patents and Trademarks*